US011470924B2

(12) United States Patent
Laroussini

(10) Patent No.: US 11,470,924 B2
(45) Date of Patent: Oct. 18, 2022

(54) EXPANDABLE LINK

(71) Applicant: Sheila Laroussini, LaGrange, GA (US)

(72) Inventor: Sheila Laroussini, LaGrange, GA (US)

( * ) Notice: Subject to any disclaimer, the term of this patent is extended or adjusted under 35 U.S.C. 154(b) by 0 days.

(21) Appl. No.: 17/001,671

(22) Filed: Aug. 24, 2020

(65) Prior Publication Data

US 2021/0052046 A1 Feb. 25, 2021

Related U.S. Application Data

(60) Provisional application No. 62/890,605, filed on Aug. 22, 2019.

(51) Int. Cl.
*A44C 5/08* (2006.01)

(52) U.S. Cl.
CPC ..... *A44C 5/08* (2013.01)

(58) Field of Classification Search
CPC ..... A44C 5/08; A44C 5/102; A44C 5/105; A44C 5/10; A44C 5/04; A44C 11/00; F16G 15/00; F16G 15/12
USPC ..... 63/38, 4, 5.1; 59/82, 90, 84; D11/12, 19
See application file for complete search history.

(56) References Cited

U.S. PATENT DOCUMENTS 197,655 A * 11/1877 Nevins ..... F16G 13/14 59/90
241,955 A * 5/1881 Freeman ..... F16G 13/14 59/90
263,095 A * 8/1882 Ballou ..... A44C 11/00 59/80
416,497 A * 12/1889 Redwood ..... A44C 5/08 59/79.1
1,774,753 A * 9/1930 Lashar ..... F16G 13/14 59/90
D340,662 S * 10/1993 Cipolla ..... D11/12

* cited by examiner

*Primary Examiner* — Jack W Lavinder
(74) *Attorney, Agent, or Firm* — Charlena Thorpe, Esq.; Incorporating Innovation LLC

(57) ABSTRACT

Implementations of an expandable link are provided. In some implementations, the expandable link comprises a first piece and a second piece moveably connected in an adjustable length configuration.
In some implementations, a method of using the expandable link comprises adjusting the expandable link to increase or reduce the length of the expandable link. In some implementations, a method of using the expandable link comprises connecting one or more of the expandable links to form an adjustable portion of a piece of jewelry or to form a piece of adjustable jewelry.

18 Claims, 17 Drawing Sheets

100

300

EXPANDABLE LINK

CROSS REFERENCE TO RELATED APPLICATION

This application claims the benefit of U.S. Patent Application Ser. No. 62/890,605, which was filed on Aug. 22, 2019, and is incorporated herein by reference in its entirety.

TECHNICAL FIELD

This disclosure relates to implementations of an expandable link.

BACKGROUND

Necklaces, bracelets, or other jewelry often need to be resized to reduce or increase the length of such jewelry for a desired fit or appearance on a wearer. However, such resizing usually requires a tedious, difficult process to be performed by a jeweler, such as removing or adding pieces to the jewelry. There does not exist a connectable, adjustable length component that can be used to make jewelry, clasps, or other similar items that can be easily adjusted in length by a wearer or other user.

DETAILED DESCRIPTION

Implementations of an expandable link are provided. In some implementations, the expandable link comprises a first piece and a second piece moveably connected in an adjustable length configuration.

In some implementations, the expandable link is configured to be adjustable in length.

In some implementations, the expandable link is configured to be used in adjustable length jewelry. In some implementations, the expandable link is configured to be used in adjustable length clasps.

In some implementations, the expandable link may be configured to be used in any other suitable adjustable length usage.

In some implementations, a method of using the expandable link comprises adjusting the expandable link to increase or reduce the length of the expandable link.

In some implementations, a method of using the expandable link comprises connecting one or more of the expandable links together to form an adjustable length necklace, bracelet, or other jewelry.

In some implementations, a method of using the expandable link comprises connecting one or more of the expandable links to one or more hooks or other connectors and to a necklace, bracelet, or other jewelry to form an adjustable length connecting clasp for the jewelry.

Figure 1A:
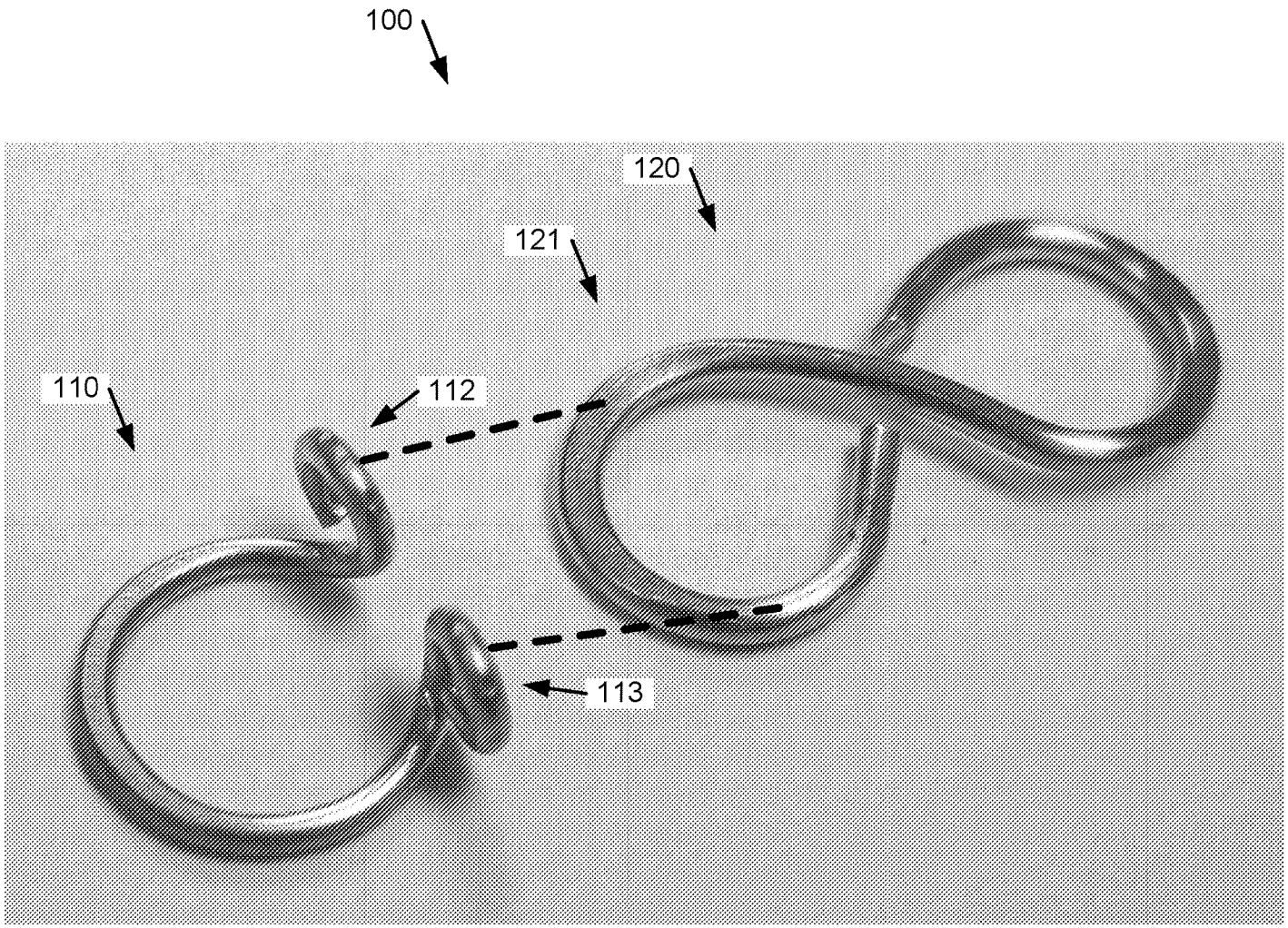
FIG. 1A illustrates an exploded view of an implementation of an example expandable link according to the present disclosure.

FIG. 1A illustrates an exploded view of an implementation of an example expandable link 100 according to the present disclosure. As shown in FIG. 1A, in some implementations, the expandable link 100 comprises a first piece 110 and a second piece 120.

Figure 1C:
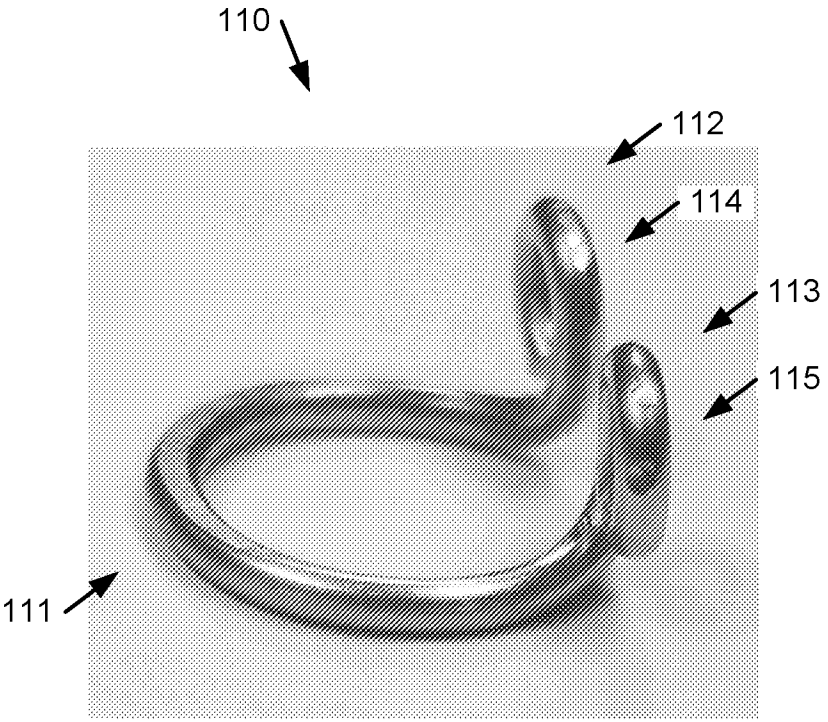
FIGS. 1B-1D illustrate various views of an implementation of an example first piece of the expandable link according to the present disclosure.
Figure 1B:
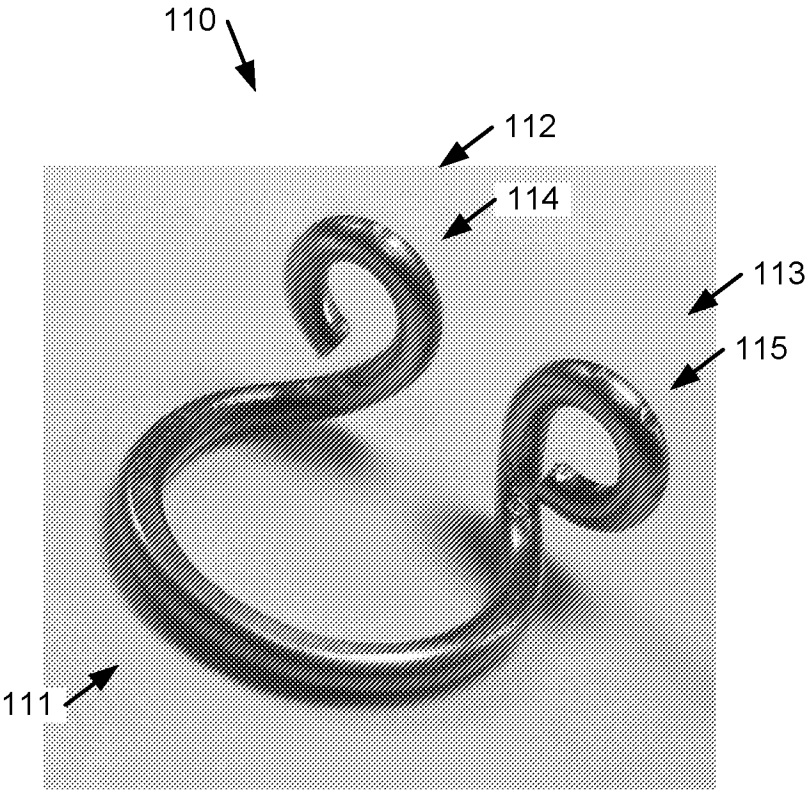
Figure 1E:
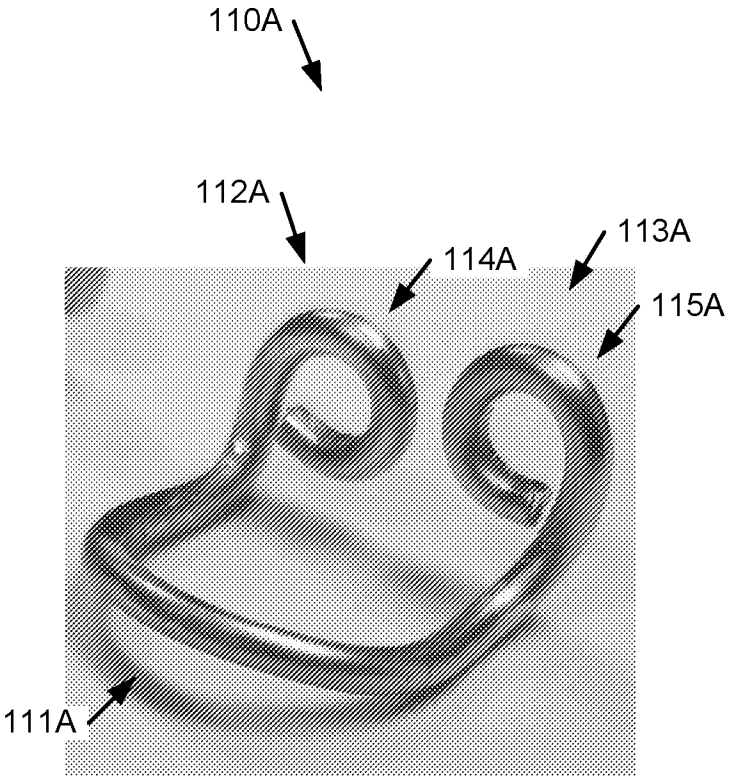
FIG. 1E illustrates another implementation of an example first piece of the expandable link according to the present disclosure.
Figure 1D:
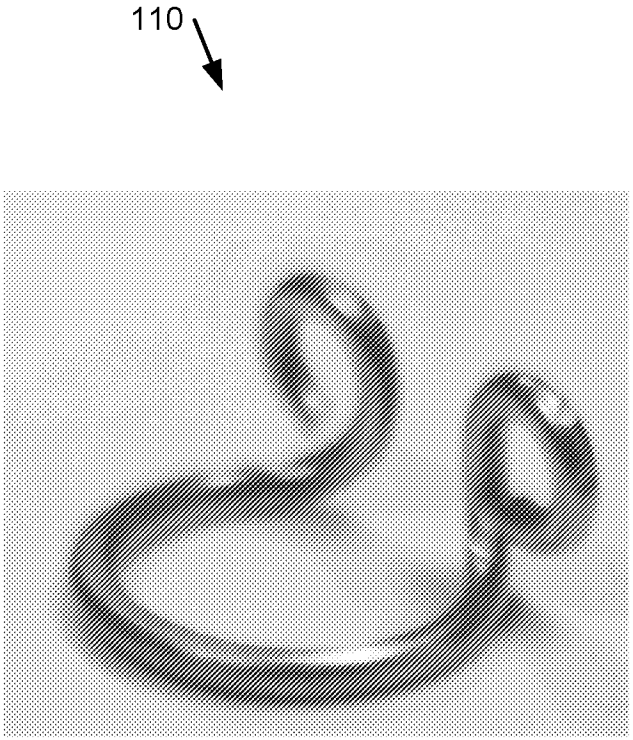

FIGS. 1B-1D illustrate various views of an implementation of an example first piece 110 of the expandable link according to the present disclosure. As shown in FIG. 1B, in some implementations, the first piece 110 comprises a curved portion 111, a first end 112, a second end 113, a first opening 114, and a second opening 115.

In some implementations, the first end 112 is bent 90 degrees (or about 90 degrees) from the curved portion 111. For example, as shown in FIG. 1C, when the curved portion 111 is positioned generally horizontal, such as on a table, the first end 112 extends generally vertical from the curved portion 111. As shown in FIG. 1B, in some implementations, the first end 112 is also curved outward to form the first opening 114.

As shown in FIG. 1B, in some implementations, similar to the first end 112, the second end 113 is bent 90 degrees (or about 90 degrees) from the curved portion 111 and is curved outward to form the second opening 115. In some implementations, the second end 113 is curved outward in an opposite facing direction from the first end 112.

FIG. 1E illustrates another implementation of an example first piece 110A of the expandable link 100 according to the present disclosure. In some implementations, the first piece 110A is generally the same or similar to the first piece 110 described above for FIGS. 1B-1D. For example, as shown in FIG. 1E, in some implementations, the first piece 110A comprises a curved portion 111A, a first end 112A, a second end 113A, a first opening 114A, and a second opening 115A that are generally the same or similar to the like-named components of the first piece 110.

As shown in FIG. 1E, in some implementations, generally the same or similar to the first piece 110, the ends 112A, 113A are bent respectively 90 degrees (or about 90 degrees) from the curved portion 111A. However, in some implementations, the ends 112A, 113A are curved inward respectively to form the openings 114A, 115A. That is, in some implementations, the ends 112A, 113A are curved inward respectively facing toward each other.

Figure 1G:
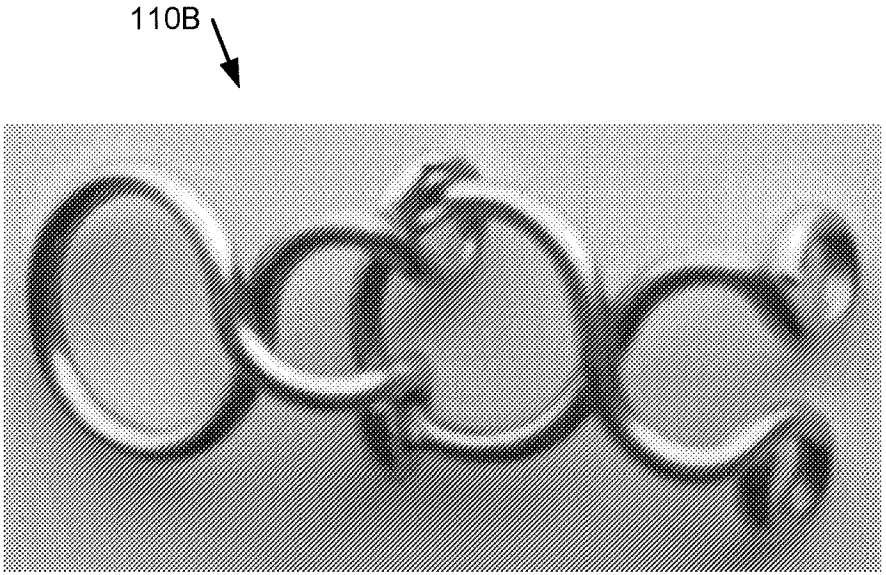
FIGS. 1F-1G illustrate another implementation of an example first piece of the expandable link according to the present disclosure.
Figure 1F:
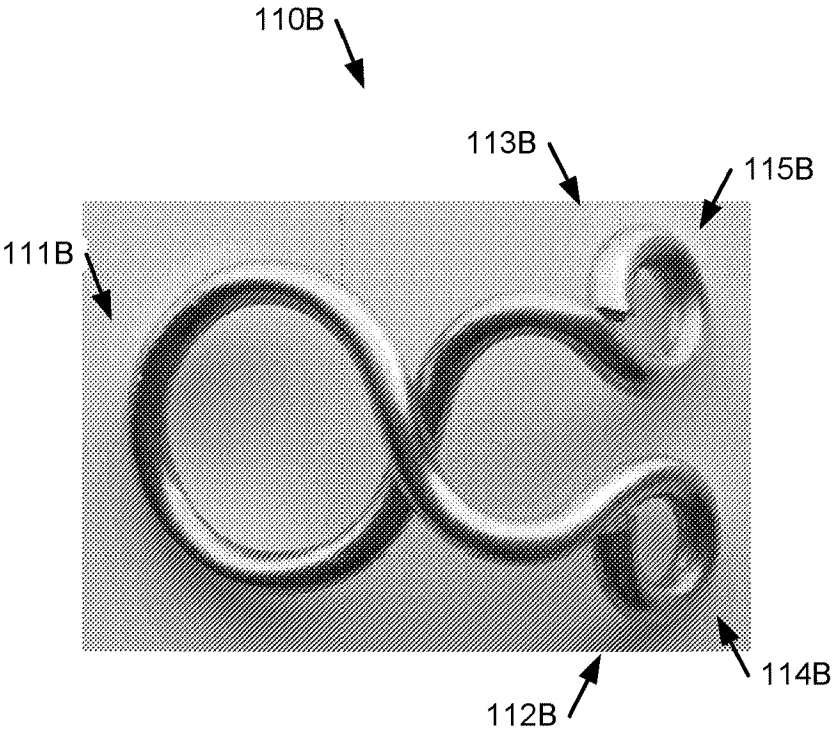

FIGS. 1F-1G illustrate another implementation of an example first piece 110B of the expandable link 100 according to the present disclosure. In some implementations, the first piece 110B is generally the same or similar to the first piece 110 described above for FIGS. 1B-1D. For example, as shown in FIG. 1F, in some implementations, the first piece 110B comprises a curved portion 111B, a first end 112B, a second end 113B, a first opening 114B, and a second opening 115B that are generally the same or similar to the like-named components of the first piece 110.

As shown in FIG. 1F, in some implementations, generally the same or similar to the first piece 110, the ends 112B, 113B are bent respectively 90 degrees (or about 90 degrees) from the curved portion 111B and are curved outward respectively to form the openings 114B, 115B.

However, as shown in FIG. 1F, in some implementations, the ends 112B, 113B extending from the curved portion 111B cross over each other to the opposite sides of the curved portion 111B (e.g., in contrast to the ends 112, 113 of the first piece 110 in FIGS. 1B-1D). In some implementations, the ends 112B, 113B may cross over before or after bending from the curved portion 111B.

In some implementations, the cross over design of the ends 112B, 113B allows a user to apply additional sufficient force (e.g., by squeezing together the sides of the curved portion 111B) to reposition the first piece 110E to another position along the second piece 120, as described more below with respect to FIGS. 2A-2C.

Figure 1I:
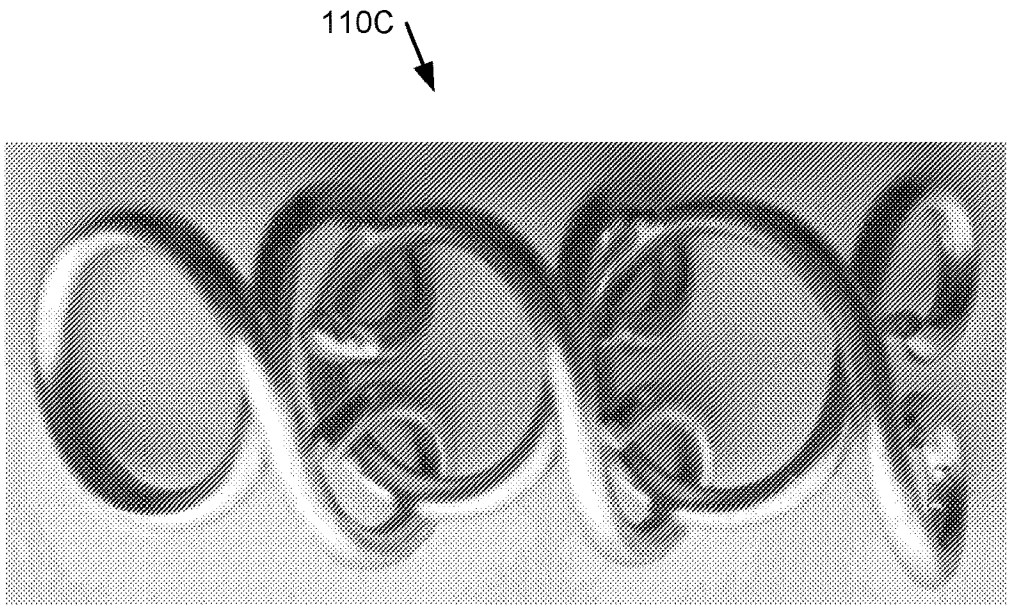
FIGS. 1H-1I illustrate another implementation of an example first piece of the expandable link according to the present disclosure.
Figure 1H:
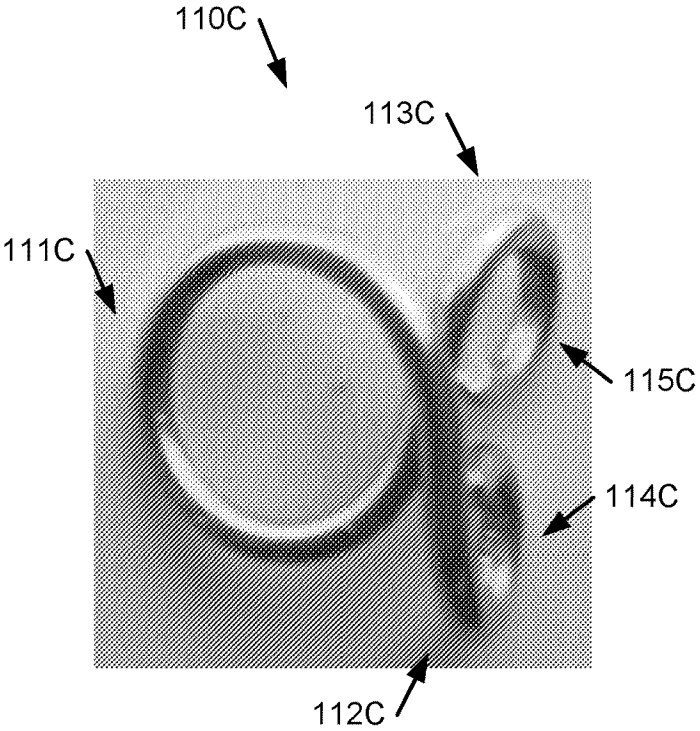

FIGS. 1H-1I illustrate another implementation of an example first piece of the expandable link according to the present disclosure. In some implementations, the first piece 110C is generally the same or similar to the first piece 110A described above for FIG. 1E. For example, as shown in FIG. 1H, in some implementations, the first piece 110C comprises a curved portion 111C, a first end 112C, a second end 113C, a first opening 114C, and a second opening 115C that are generally the same or similar to the like-named components of the first piece 110A.

As shown in FIG. 1H, in some implementations, generally the same or similar to the first piece 110A, the ends 112C, 113C are bent respectively 90 degrees (or about 90 degrees) from the curved portion 111C and are curved inward respectively to form the openings 114C, 115C.

However, as shown in FIG. 1H, in some implementations, the ends 112C, 113C extending from the curved portion 111C cross over each other to the opposite sides of the curved portion 111C (e.g., in contrast to the ends 112A, 113A of the first piece 110A in FIG. 1E). In some implementations, the ends 112C, 113C may cross over before or after bending from the curved portion 111C.

In some implementations, the cross over design of the ends 112C, 113C allows a user to apply additional sufficient force (e.g., by squeezing together the sides of the curved portion 111C) to reposition the first piece 110C to another position along the second piece 120, as described more below with respect to FIGS. 2A-2C.

In some implementations, the descriptions herein of the first piece 110 with respect to the expanding link 100 also suitably apply and/or imply reference to the above-described alternate implementation first pieces 110A, 11B, and/or 11C, as will be recognized by one skilled in the art with the benefit of the present disclosure.

Figure 1J:
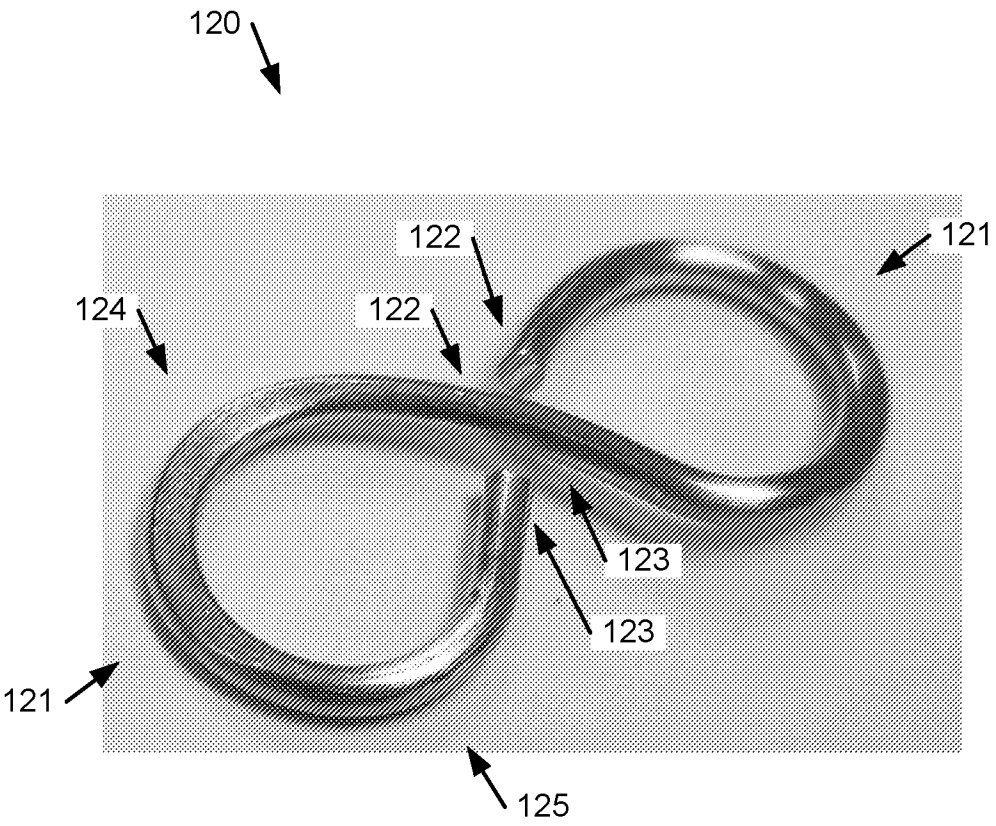
FIG. 1J illustrates an implementation of an example second piece of the expandable link according to the present disclosure.

FIG. 1J illustrates an implementation of an example second piece 120 of the expandable link 100 according to the present disclosure. As shown in FIG. 1J, in some implementations, the second piece 120 comprises a curved portion 121, a first end 122, and a second end 123. In some implementations, the curved portion 121 comprises a first side 124 and a second side 125.

In some implementations, the curved portion 121 is similar to the above-described curved portion 111 of the first piece 110. However, in some implementations, the ends 122, 123 extend from the curved portion 121 to form a loop or semi-loop. For example, in some implementations, the ends 122, 123 extend coplanar or generally coplanar to the curved portion 121.

In some implementations, the curved portion 121 and the ends 122, 123 form a circular or semi-circular loop. In some implementations, the curved portion 121 and the ends 122, 123 form a loop or semi-loop of any other suitable shape.

As shown in FIG. 1J, in some implementations, the second piece 120 may comprise a pair of curved portions 121 and ends 122, 123 that connect to form a figure eight shaped loop (or double loop). Alternately, in some implementations, the second piece 120 may comprise the form of a single loop or ring (such as shown in FIG. 4D) or of three or more loops or rings (not shown) from the curved portion(s) 121 and the ends 122, 123.

Figure 2A:
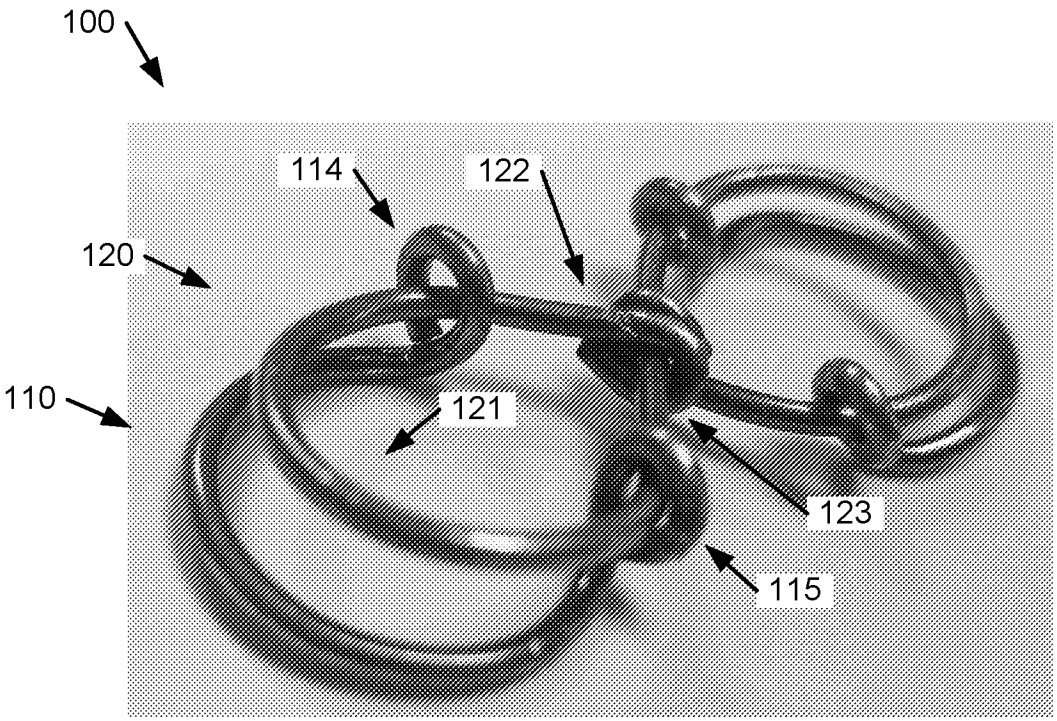
FIGS. 2A-2C illustrate an assembled view of the expandable link according to the present disclosure.
Figure 2B:
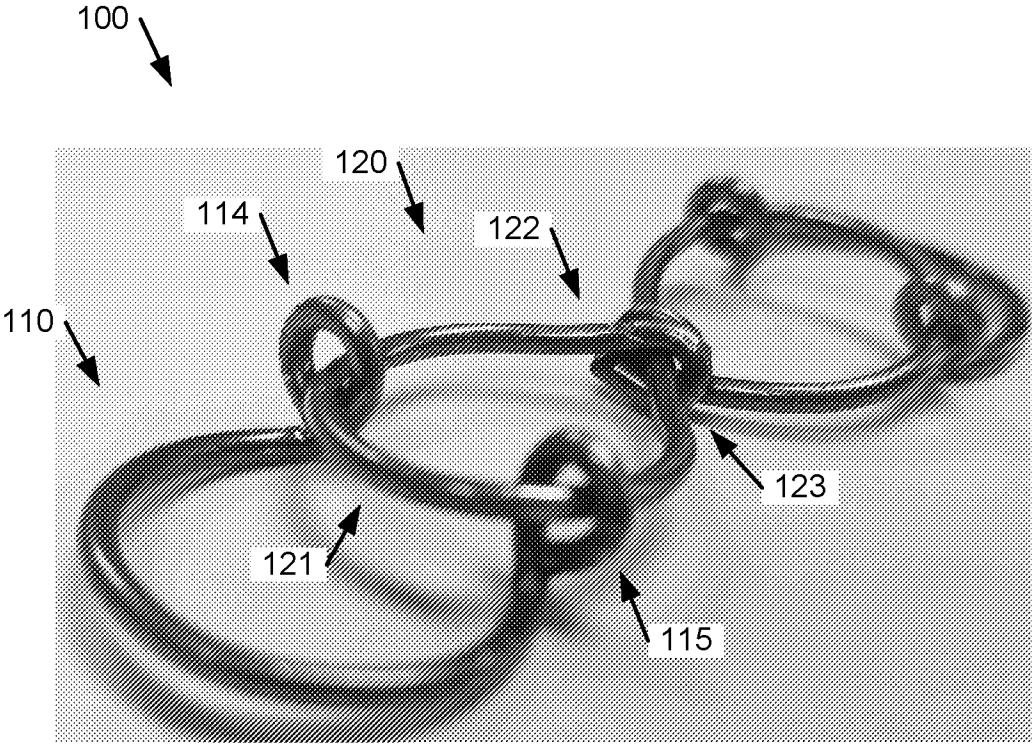
Figure 2C:
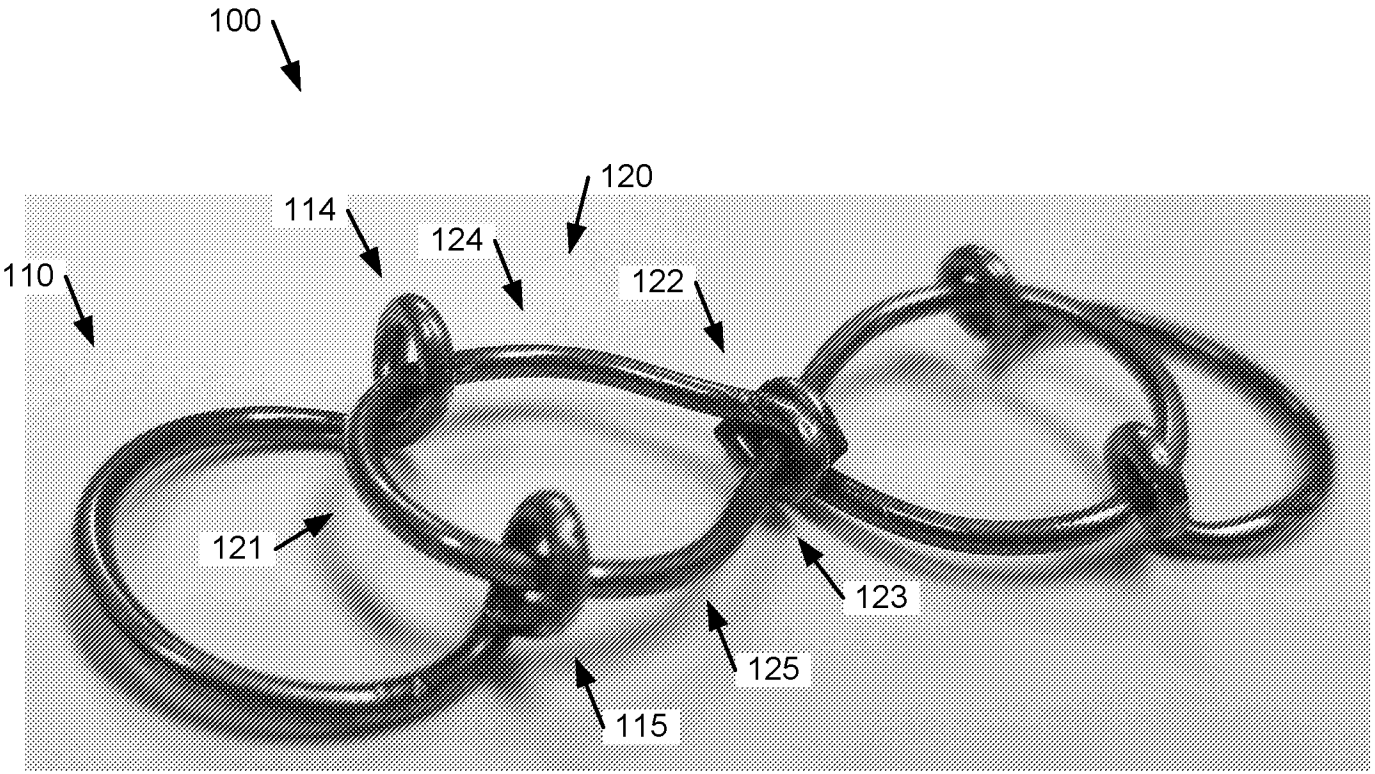

FIGS. 2A-2C illustrate an assembled view of the expandable link 100 according to the present disclosure. As shown in FIG. 2C, in some implementations, the expandable link 100 comprises the above-described first piece 110 (or alternate implementation first piece 110A, 11B, or 11C) and second piece 120.

As shown in FIG. 2C, in some implementations, the first piece 110 and the second piece 120 are moveably/adjustably connected together. That is, in some implementations, the sides 124, 125 of the curved portion 121 extend respectively through the openings 114, 115 of the first piece 110. In this way, in some implementations, the first piece 110 and the second piece 120 are moveably/adjustably interlocked.

As shown in FIGS. 2A-2C, in some implementations, the first piece 110 and the second piece 120 are connected/interlocked such that the length of the expandable link 100 is adjustable by positioning the first piece 110 along different positions of the curved portion 121 of the second piece 120. For example, as shown in FIG. 2A, in some implementations, the length of the expandable link 100 can be reduced or shortened by positioning the first piece 110 so that the openings 114, 115 are nearer respectively to the ends 122, 123 of the second piece 120.

Similarly, as shown in FIGS. 2B and 2C, in some implementations, the length of the expandable link 100 can be increased or lengthened by positioning the first piece 110 so that the openings 114, 115 are farther away respectively from the ends 122, 123 of the second piece 120.

In some implementations, the shape (e.g., the curvature) of the first piece 110 and/or of the second piece 120 is configured such that the first piece 110 will remain in a position along the curved portion 121 of the second piece 120 until sufficient force is used to reposition the first piece 110 to another position along the second piece 120. In this way, in some implementations, the first piece 110 and the second piece 120 are configured such that the first piece 110 snugly and/or securely positions along the second piece 120.

Figure 3A:
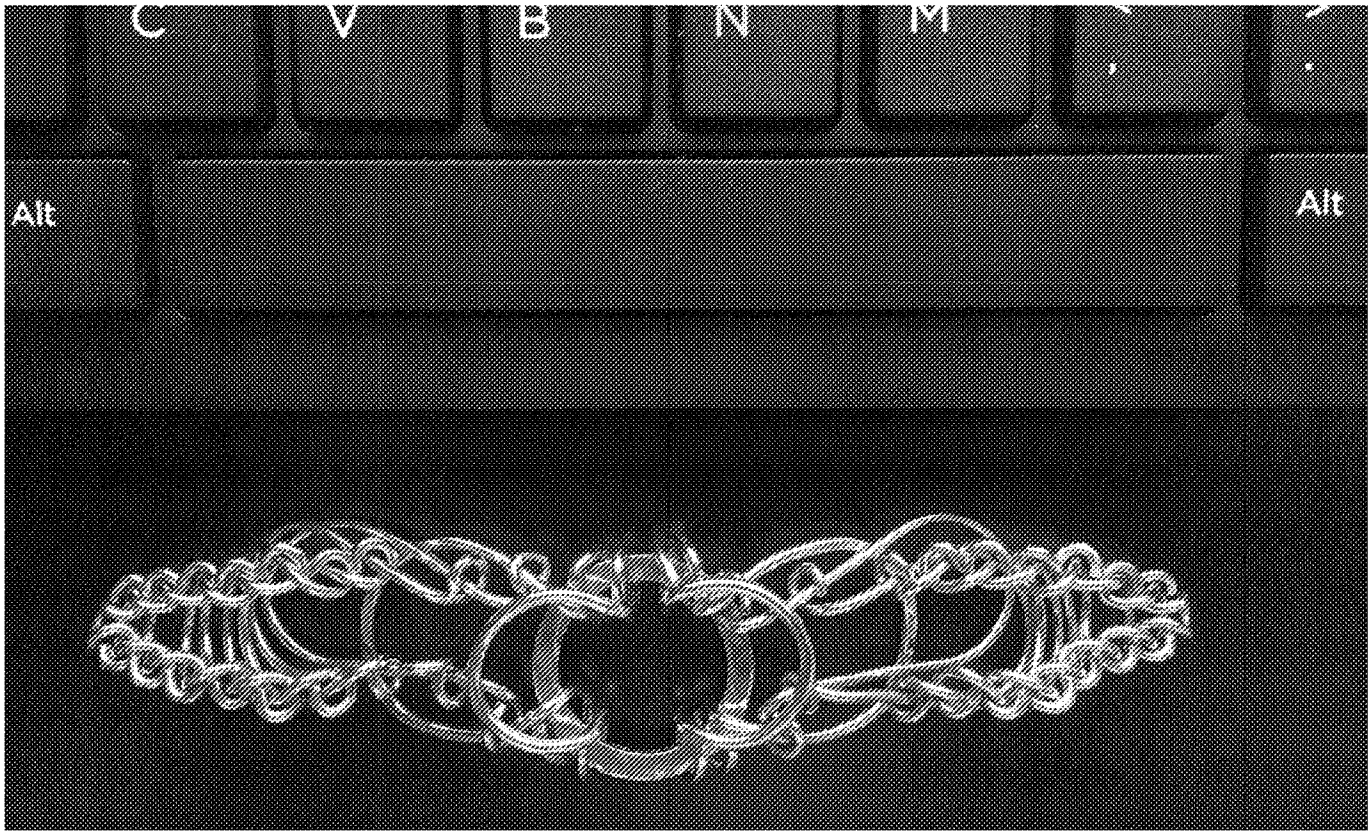
FIGS. 3A-3D illustrate examples of adjustable length jewelry made from the expandable link according to the present disclosure.
Figure 3B:
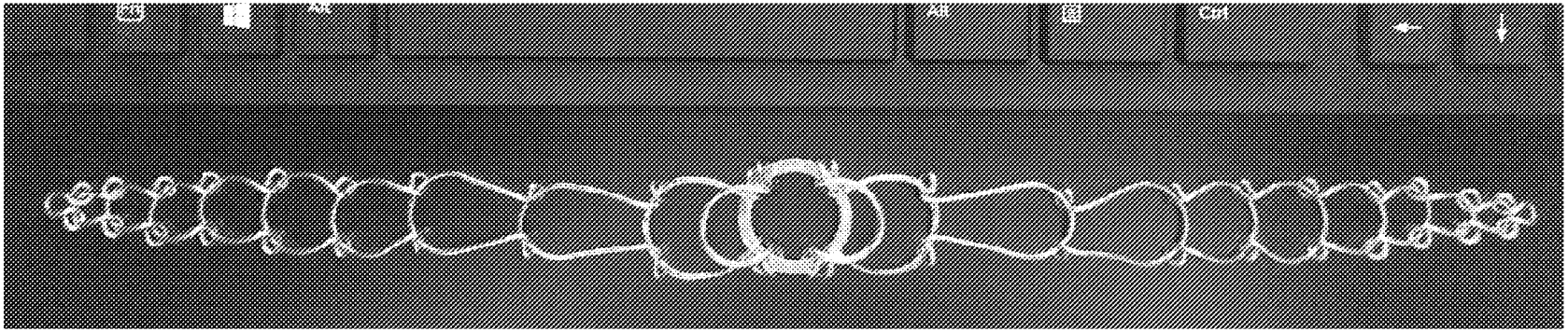
Figure 3C:
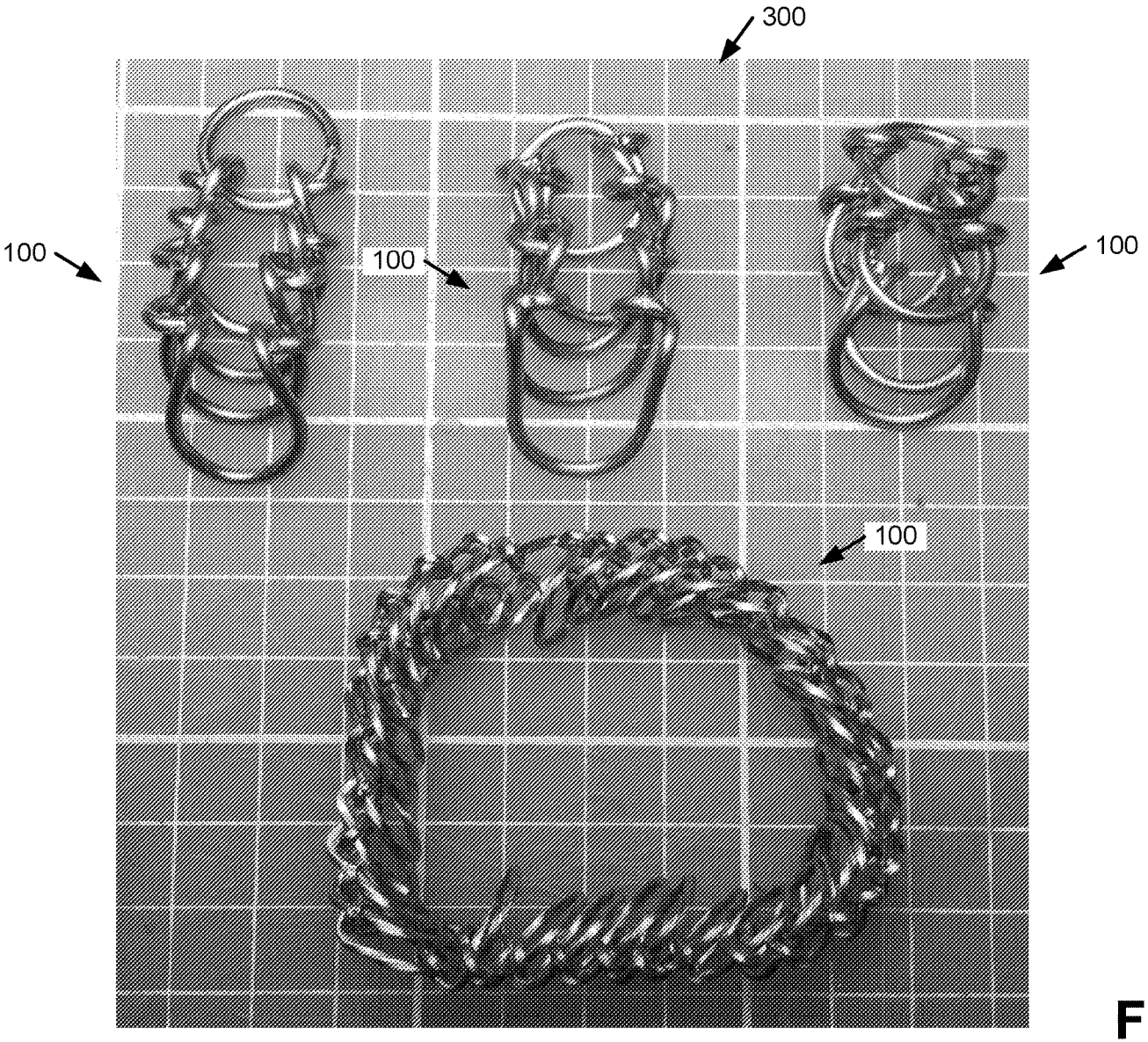
Figure 4A:
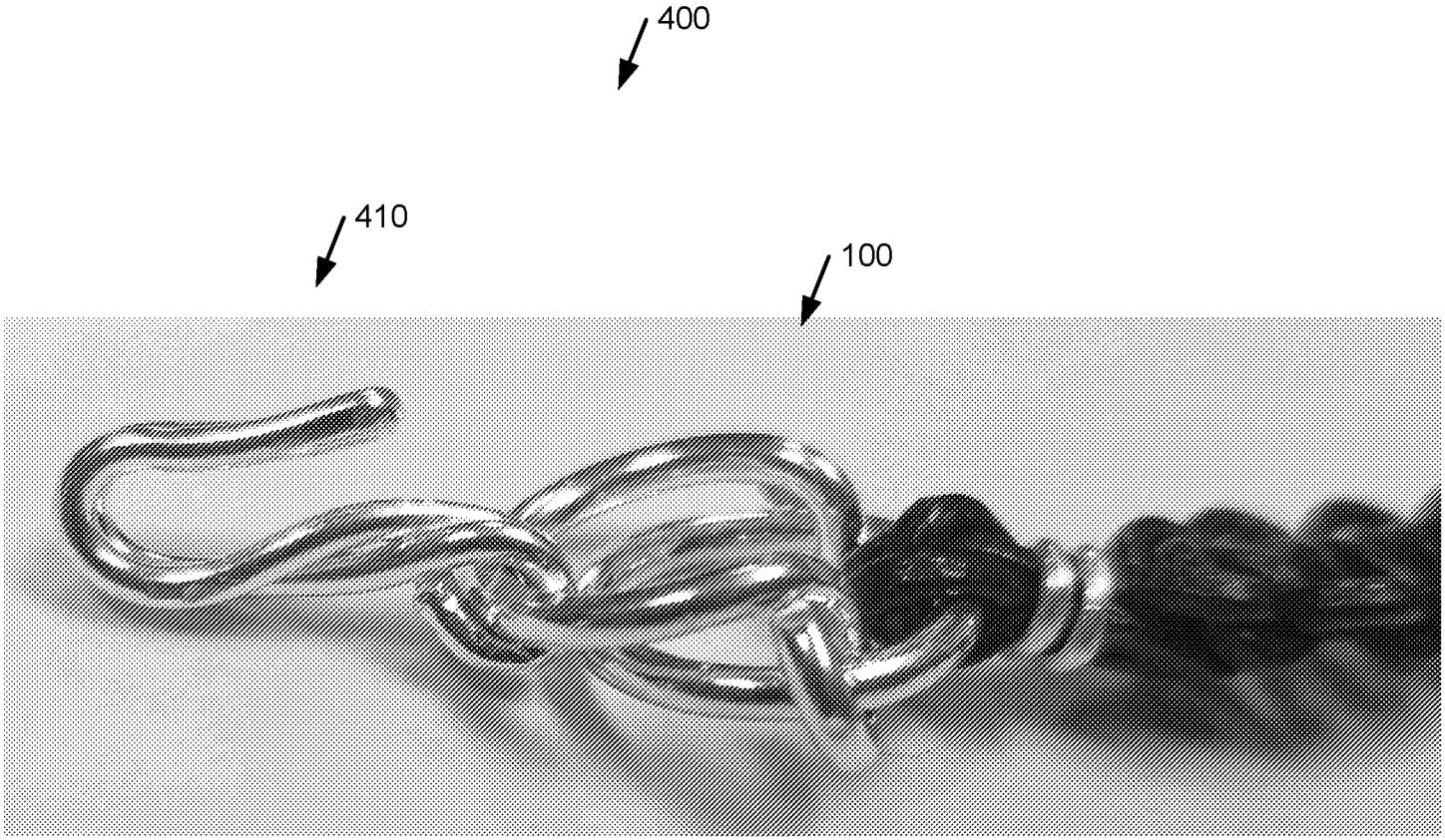
FIGS. 4A-4D illustrate examples of adjustable length clasps made from the expandable link according to the present disclosure.
Figure 4B:
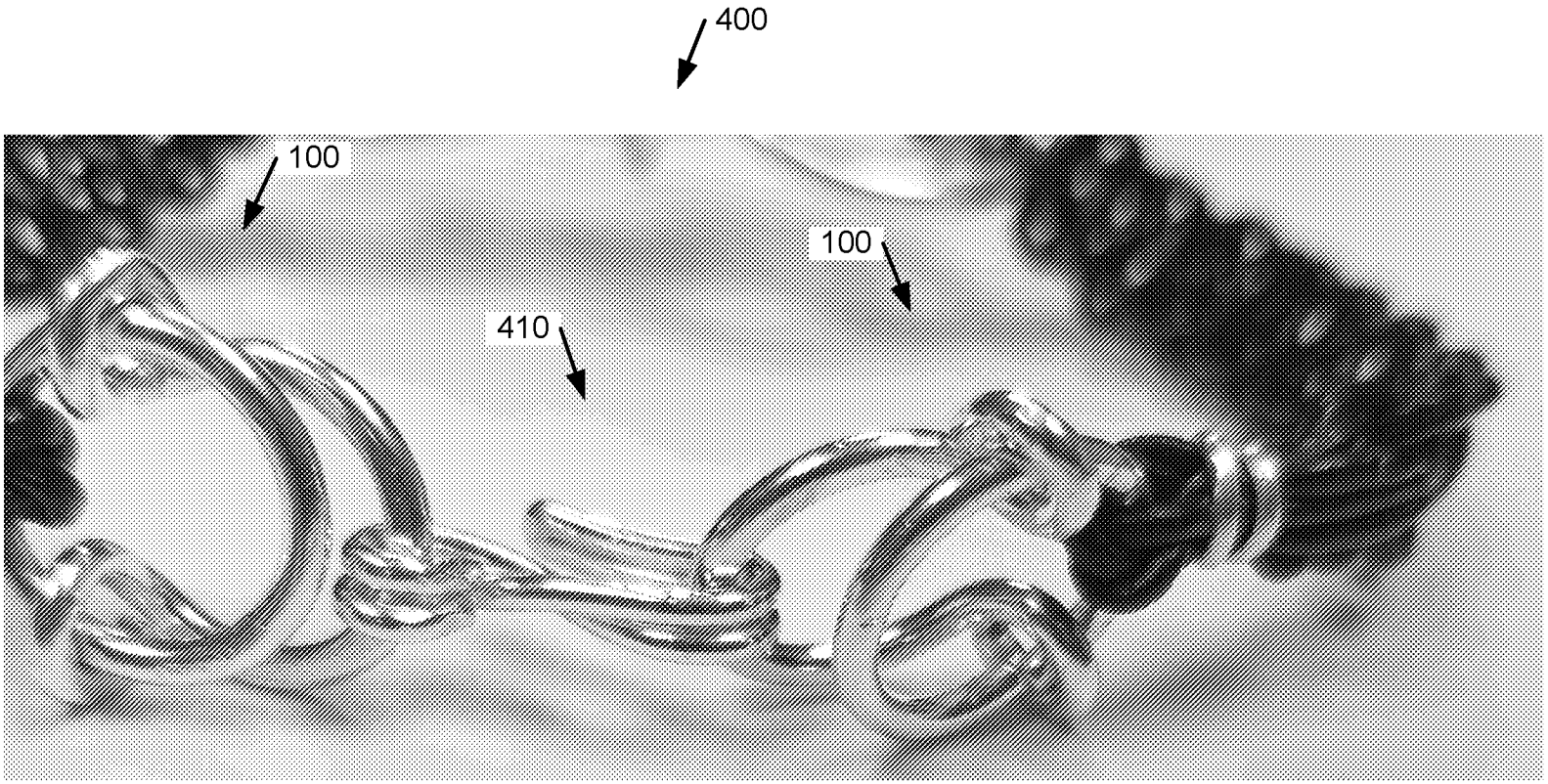
Figure 4C:
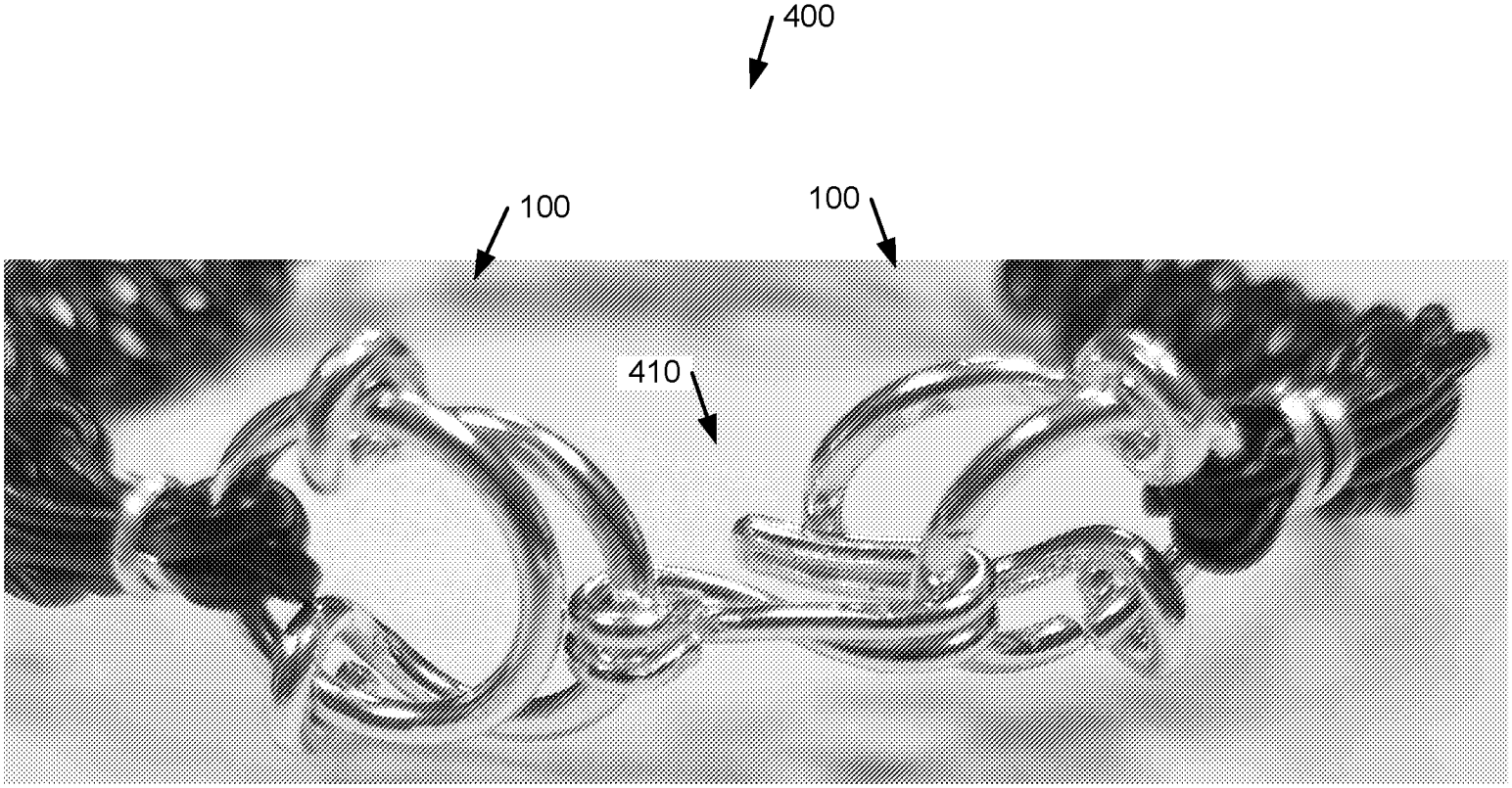
Figure 4D:
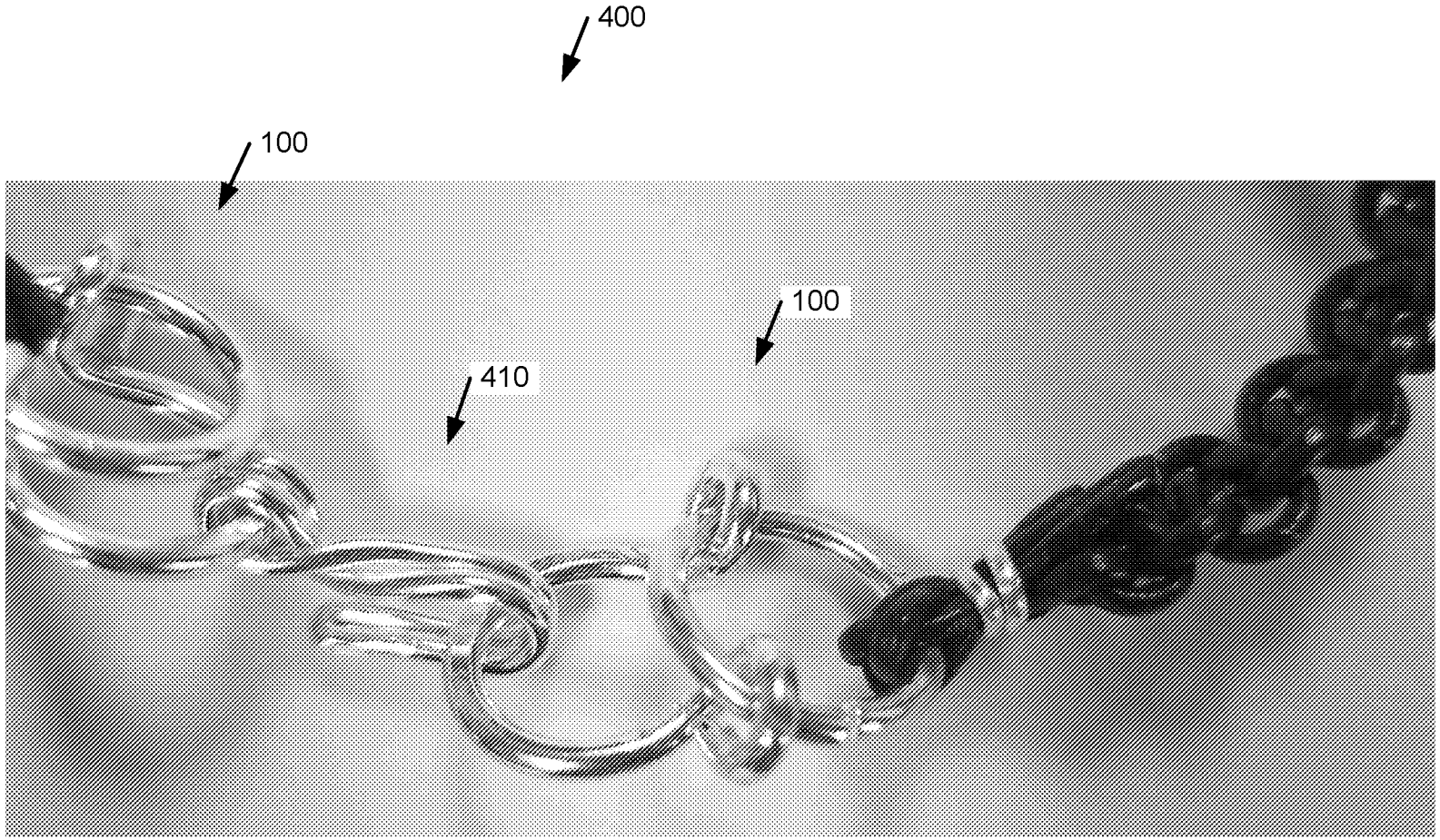

As shown in FIG. 1A and FIGS. 3B and 4B (described below), the first piece 110 and the second piece 120 may comprise any curved shape so long as the first piece 110 comprises the above-described 90 degree bend (or about 90 degree bend) on the distal ends 112, 113 (as described above) and the first piece 110 can move along the curved portion 121 of the second piece 120 (as also described above).

Figure 3D:
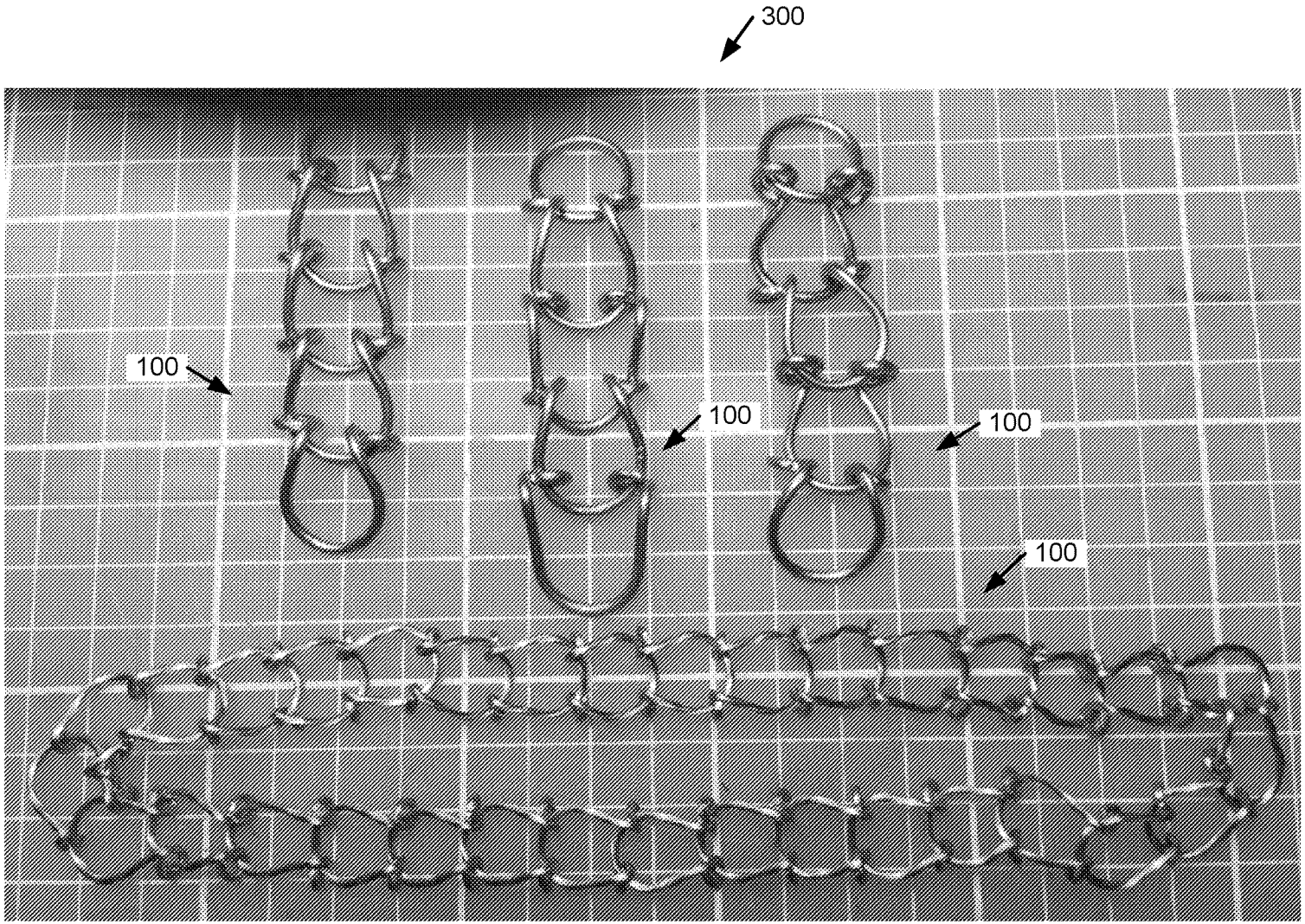

As shown in FIG. 3D (described below), in some implementations, the second piece 120 may comprise the same shape as the first piece 110. For example, in some implementations, a plurality of first pieces 110, such as shown in FIG. 1B, may be nested together to form jewelry from the expandable link 100, such as shown in FIG. 3D.

It will be understood by one skilled in the art with the benefit of the present disclosure that components of the expandable link 100, such as the pieces 110, 120, may be made by hand, machine, or any other suitable way. In that regard, the bends in the pieces 110, 120 of about 90 degrees (e.g., indicating 90 degrees, less than 90 degrees, or greater than 90 degrees) described herein will be understood by one skilled in the art to be the result of variation, tolerance, error, etc. during the making of the expandable link 100 by hand, machine, or other suitable way.

In some implementations, the expandable link 100 is configured to be adjustable in length.

In some implementations, the expandable link 100 is configured to be used in adjustable length jewelry. In some implementations, the expandable link 100 is configured to be used in adjustable length clasps.

In some implementations, the expandable link 100 may be configured to be used in any other suitable adjustable length usage.

FIGS. 3A-3D illustrate examples of adjustable length jewelry 300 made from the expandable link 100 according to the present disclosure. For example, as shown in FIGS. 3A-3D, in some implementations, a plurality of the expandable links 100 may be connected together to form an adjustable length necklace, bracelet, or other jewelry 300.

FIGS. 4A-4D illustrate examples of adjustable length clasps 400 made from the expandable link 100 according to the present disclosure. For example, as shown in FIGS. 4A-4D, in some implementations, one or more expandable links 100 may be connected to one or more hooks or other connectors 410 and to a necklace, bracelet, or other jewelry to form an adjustable length connecting clasp for the jewelry.

In some implementations, the expandable link 100 comprises any suitable dimensions.

In some implementations, the expandable link 100 is composed of any suitable material. For example, in some implementations, the expandable link 100 may be composed of one or more metallic materials, such as steel, brass, copper, silver, or gold. In some implementations, the expandable link 100 may be composed of one or more plastic materials, such as polyethylene, polyvinyl chloride, polypropylene, polycarbonate, or acrylic.

In some implementations, the expandable link 100 is composed of any suitable form of such material. For example, in some implementations, the expandable link 100 may be composed of an elongated form of such material. In some implementations, the expandable link 100 may be composed of a cylindrical shaped form of such material. In some implementations, the expandable link 100 may be composed of a form of such material having any other suitable shape and/or other feature.

In some implementations, the expandable link 100 can have any suitable appearance, such as the examples shown in the above described figures.

In some implementations, an example method of using the expandable link 100, with respect to the above described FIGS. 2A-2C, comprises reducing the length of the expandable link 100 by positioning the first piece 110 so that the openings 114, 115 are nearer respectively to the ends 122, 123 of the second piece 120. In some implementations, the method comprises increasing the length of the expandable link 100 by positioning the first piece 110 so that the openings 114, 115 are farther away respectively from the ends 122, 123 of the second piece 120.

In some implementations, the first piece 110 remains in a position along the second piece 120 until sufficient force is used to reposition the first piece 110 to another position along the second piece 120.

In some implementations, an example method of using the expandable link 100, with respect to the above described FIGS. 3A-3D, comprises connecting a plurality of the expandable links 100 together to form an adjustable length necklace, bracelet, or other jewelry 300.

In some implementations, an example method of using the expandable link 100, with respect to the above described FIGS. 4A-4D, comprises connecting one or more expandable links 100 to one or more hooks or other connectors 410 and to a necklace, bracelet, or other jewelry to form an adjustable length connecting clasp 400 for the jewelry.

The figures, including photographs and drawings, comprised herewith may represent one or more implementations of the expandable link.

Details shown in the figures, such as dimensions, descriptions, etc., are exemplary, and there may be implementations of other suitable details according to the present disclosure.

Reference throughout this specification to "an embodiment" or "implementation" or words of similar import means that a particular described feature, structure, or characteristic is comprised in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations may be depicted in the drawings in a particular order, this should not be understood as requiring that such operations be performed in the particular order shown or in sequential order, or that all illustrated operations be performed, to achieve desirable results.

The invention claimed is:

1. An expandable link comprising:

a first piece and a second piece, wherein:

the first piece comprises:

a curved portion extending in a first plane;

a first end extending from the curved portion in a second plane and curved to form a first opening; and a second end extending from the curved portion in a third plane and curved to form a second opening wherein the second plane and third plane are common or nearly common and perpendicular or nearly perpendicular to the first plane; and the second piece comprises a curved portion configured to movably extend through the first opening and the second opening of the first piece to interlock the first piece with the second piece.

2. The expandable link of claim 1 wherein the expandable link is configured such that the first opening and the second opening of the first piece are movable along the curved portion of the second piece such that the length of the expandable link is adjustable.

3. A method of using the expandable link of claim 2 comprising adjusting the length of the expandable link by moving the first opening and the second opening of the first piece along the curved portion of the second piece.

4. The expandable link of claim 1 wherein the curvature of the first piece and the curvature of the second piece are configured such that the first opening and the second opening of the first piece remain positioned along the curved portion of the second piece until a force is applied to the first piece to move the first opening and the second opening each to another position along the curved portion of the second piece.

5. A method of using the expandable link of claim 4 comprising moving the first opening and the second opening of the first piece each from a first position to a second position along the curved portion of the second piece by applying a force to the first piece.

6. The expandable link of claim 1 wherein the first end and the second end of the first piece cross over before forming the first opening and the second opening of the first piece.

7. The expandable link of claim 1 wherein the second piece comprises at least one loop.

8. The expandable link of claim 1 wherein the second piece further comprises a first end and a second end, wherein:

the curved portion of the second piece extends in a fourth plane;

the first end extends from the curved portion of the second piece in a fifth plane and is curved to form a first opening; and the second end extends from the curved portion of the second piece in a sixth plane and is curved to form a second opening.

9. The expandable link of claim 8 wherein:

the fourth plane and fifth plane are about 90 degrees apart; and the fourth plane and sixth plane are about 90 degrees apart.

10. The expandable link of claim 1 further comprising a third piece, wherein:

the third piece comprises:

a curved portion extending in a fourth plane;

a first end extending from the curved portion of the third piece in a fifth plane and curved to form a first opening; and a second end extending from the curved portion of the third piece in a sixth plane and curved to form a second opening; and the curved portion of the second piece configured to movably extend through the first opening and the second opening of the third piece to interlock the third piece with the second piece.

11. The expandable link of claim 10 wherein:

the fourth plane and fifth plane are about 90 degrees apart; and the fourth plane and sixth plane are about 90 degrees apart.

12. A method of using the expandable link of claim 1 comprising connecting the first piece and the second piece to a piece of jewelry to form an adjustable portion of the jewelry that is adjustable by moving the curved portion of the second piece through the first opening and the second opening of the first piece.

13. The method of claim 12 further comprising adjusting the adjustable portion of the jewelry by moving the curved portion of the second piece through the first opening and the second opening of the first piece.

14. An expandable link comprising:

at least two pieces, wherein each of the pieces comprises:

a curved portion extending in a first plane;

a first end extending from the curved portion in a second plane and curved to form a first opening; and a second end extending from the curved portion in a third plane and curved to form a second opening wherein the second plane and third plane are common or nearly common and perpendicular or nearly perpendicular to the first plane; and the curved portion of at least one of the pieces is configured to movably extend through the first opening and the second opening of at least another of the pieces to interlock the at least one of the pieces with the at least other of the pieces.

15. The expandable link of claim 14 wherein the pieces are configured such that the first opening and the second opening of the at least other of the pieces are configured to move along the curved portion of the at least one of the pieces such that the length of the expandable link is adjustable.

16. The expandable link of claim 14 wherein the curvature of the pieces are configured such that the first opening and the second opening of the at least other of the pieces remain positioned along the curved portion of the at least one of the pieces until a force is applied to the at least other of the pieces to move the first opening and the second opening of the at least other of the pieces each to another position along the curved portion of the at least one of the pieces.

17. A method of using the expandable link of claim 14 comprising forming an adjustable piece of jewelry by successively connecting a plurality of the pieces together such that the curved portion of each of the plurality of the pieces movably extends through the first opening and the second opening of at least one of another of the plurality of the pieces to interlock the pieces together.

18. The method of claim 17 further comprising adjusting the adjustable piece of jewelry by moving the curved portion of at least one of the plurality of the pieces through the first opening and the second opening of the at least one of another of the plurality of the pieces that is interlocked together with the at least one of the plurality of the pieces.

* * * * *